US012285045B2

(12) United States Patent
Feng et al.

(10) Patent No.: US 12,285,045 B2
(45) Date of Patent: Apr. 29, 2025

(54) ATOMIZER FOR ELECTRONIC CIGARETTE AND ELECTRONIC CIGARETTE

(71) Applicant: LUXSHARE PRECISION INDUSTRY CO., LTD., Shenzhen (CN)

(72) Inventors: Yun Feng, Shenzhen (CN); Huabing Li, Shenzhen (CN); Zhongyuan Lai, Shenzhen (CN); Yu Huang, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 538 days.

(21) Appl. No.: 17/692,641

(22) Filed: Mar. 11, 2022

(65) Prior Publication Data

US 2022/0354166 A1 Nov. 10, 2022

(30) Foreign Application Priority Data

May 6, 2021 (CN) ..... 202110491502.9

(51) Int. Cl.
*A24F 40/10* (2020.01)
*A24F 40/46* (2020.01)

(52) U.S. Cl.
CPC ..... *A24F 40/10* (2020.01); *A24F 40/46* (2020.01)

(58) Field of Classification Search
None
See application file for complete search history.

(56) References Cited

U.S. PATENT DOCUMENTS 10,849,362 B2 * 12/2020 Jiang ..... H05B 3/42
2022/0071283 A1 * 3/2022 Qiu ..... A24F 40/485
(Continued)

FOREIGN PATENT DOCUMENTS

CN 104010528 A 8/2014
CN 205885978 U 1/2017
CN 206403200 U 8/2017
(Continued)

*Primary Examiner* — Felix O Figueroa
(74) *Attorney, Agent, or Firm* — McNees Wallace & Nurick LLC

(57) ABSTRACT

An atomizer for an electronic cigarette includes an atomization compartment housing, an atomizer assembly and an outer cover covering the atomization compartment housing. The outer cover is provided with a suction nozzle opening and a communication hole. The atomization compartment housing includes an atomization cavity, an opening and a through groove. The atomization cavity is disposed inside the atomization compartment housing, and the atomizer assembly is disposed inside the atomization cavity. The opening is disposed at an end of the atomization compartment housing and communicates with the atomization cavity. The opening and the atomization cavity form a smoke passage that communicates with the suction nozzle opening. The through groove is disposed in an outer wall of the atomization compartment housing. The through groove and the outer cover form an intake passage. Two ends of the intake passage communicate with the suction nozzle opening and the communication hole respectively.

16 Claims, 2 Drawing Sheets

(56) References Cited

U.S. PATENT DOCUMENTS

| | | | | |
|---|---|---|---|---|
| 2022/0142246 | A1* | 5/2022 | Liu | A24F 40/40 |
| 2022/0151301 | A1* | 5/2022 | Liu | A24F 40/44 |

FOREIGN PATENT DOCUMENTS

| | | | |
|---|---|---|---|
| CN | 207383527 | U | 5/2018 |
| CN | 210076581 | U | 2/2020 |
| CN | 211882179 | U | 11/2020 |

* cited by examiner

ATOMIZER FOR ELECTRONIC CIGARETTE AND ELECTRONIC CIGARETTE

CROSS-REFERENCE TO RELATED APPLICATION(S)

This application claims priority to Chinese Patent Application No. 202110491502.9 filed May 6, 2021, the disclosure of which is incorporated herein by reference in its entirety.

TECHNICAL FIELD

The present disclosure relates to the technical field of electronic cigarettes and, in particular, to an atomizer for an electronic cigarette and an electronic cigarette.

BACKGROUND

In the related art, the atomizer and electronic cigarette liquid storage structure of an electronic cigarette are an integrated structure. The atomizer can atomize electronic cigarette liquid to form smoke. One end of the electronic cigarette is an air inlet communicating with the outside air and the other end of the electronic cigarette communicates with a nozzle. When a user inhales through the nozzle, the outside air enters the atomizer and the electronic cigarette liquid storage structure through an inspiratory airflow. As a result, the smoke enters the nozzle together with the inspiratory airflow. However, the electronic cigarette in use has the following defects: One is that there is large-particle smoke after the atomizer atomizes the electronic cigarette liquid. The large-particle smoke enters the mouth of the user together with the inspiratory airflow, leaving a bad taste of the electronic cigarette and even a scald in the mouth of the user in a severe case. The other is that during the transportation of the electronic cigarette or when the user carries the electronic cigarette to move, the electronic cigarette liquid inside the electronic cigarette liquid storage structure seeps out of the atomizer or leaks from the atomizer. Since the air inlet communicates with the outside air, the user is likely to suck the electronic cigarette liquid when the user mistakes the air inlet of the electronic cigarette as the nozzle.

SUMMARY

The present disclosure provides an atomizer for an electronic cigarette. The atomizer for an electronic cigarette can improve the taste and prevent discomfort caused by sucking leaked electronic cigarette liquid.

The present disclosure adopts the solution below.

An atomizer for an electronic cigarette includes an atomization compartment housing, an atomizer assembly and an outer cover covering the atomization compartment housing. The outer cover is provided with a suction nozzle opening and a communication hole communicating with the suction nozzle opening. The atomization compartment housing includes an atomization cavity disposed inside the atomization compartment housing, an opening disposed at an end of the atomization compartment housing and communicating with the atomization cavity and a through groove disposed in an outer wall of the atomization compartment housing. The atomizer assembly is disposed inside the atomization cavity. The opening and the atomization cavity form a smoke passage that communicates with the suction nozzle opening and a side of the opening facing the suction nozzle opening can form a negative pressure such that atomized electronic cigarette liquid can flow through the opening. The through groove and the outer cover form an intake passage. Two ends of the intake passage communicate with the suction nozzle opening and the communication hole respecitvely.

Optionally, the atomization compartment housing includes a housing body and a cover plate sealedly disposed at an end of the atomization cavity facing away from the opening. The atomization cavity and the opening are disposed on the housing body that is provided with at least one through groove along a circumferential direction. The cover plate is provided with a central hole and at least one through hole communicating with the central hole. The at least one through hole is in one-to-one correspondence with and communicates with the at least one through groove and the central hole communicates with the communication hole.

Optionally, the atomization compartment housing is provided with an injection orifice communicating with the atomization cavity and further includes an injection plug configured to occlude the injection orifice. An external injector can pierce through the injection plug to inject electronic cigarette liquid into the atomization cavity. The injection plug can seal up a perforation formed by the external injector piercing through the injection plug.

Optionally, the atomization compartment housing further includes a partition disposed between the cover plate and the housing body and sealedly connected to the housing body. The injection orifice is disposed on the partition and the external injector can pierce through the central hole and the injection orifice successively.

Optionally, the atomization compartment housing further includes a magnetic module. A space is formed between the partition and the cover plate. The magnetic module is disposed in the space and is configured to attract an external power supply module.

Optionally, the atomizer assembly includes a storage compartment capable of generating heat, a flow diverting net disposed to enclose an inner compartment, and an outer wall of the storage compartment and a heating element disposed to enclose the flow diverting net. The electronic cigarette liquid is disposed inside the storage compartment.

Optionally, the storage compartment includes a compartment body, a heating metal layer disposed on the compartment body and a metal column disposed on the compartment body. The electronic cigarette liquid is disposed inside the compartment body that is secured to the atomization compartment housing through the metal column. The metal column is disposed to pierce through the atomization compartment housing and the heating metal layer is electrically connected to an external power supply module through the metal column. The heating element includes a metal net and a secure column connected to the metal net. The metal net is disposed to enclose the flow diverting net, is secured to the atomization compartment housing through the secure column that is disposed to pierce through the atomization compartment housing, and is electrically connected to an external power supply module through the secure column.

Optionally, a leakage-proof sleeve is further included. The leakage-proof sleeve is sleeved on the metal column and the secure column, sealedly connects the metal column to the atomization compartment housing and sealedly connects the secure column to the atomization compartment housing.

Optionally, the outer cover includes a first outer cover body and a second outer cover body that are connected to each other. The suction nozzle opening is disposed in the first outer cover body and the communication hole is disposed in the second outer cover body. The atomization compartment housing is disposed inside an accommodation space formed by the first outer cover body and the second outer cover body.

The present disclosure further provide an electronic cigarette that can improve the taste and prevent discomfort caused by sucking leaked electronic cigarette liquid.

The present disclosure adopts the solution below.

An electronic cigarette includes the atomizer for an electronic cigarette.

REFERENCE LIST

Figure 1:
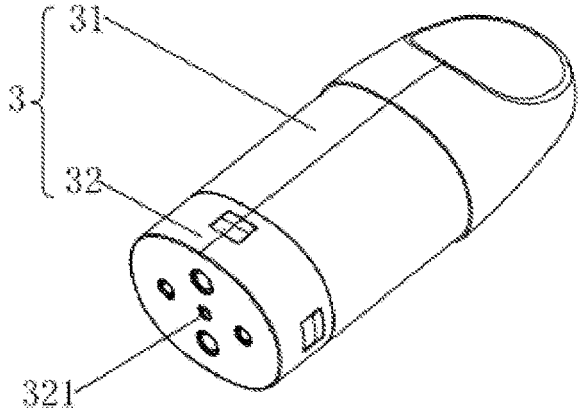
FIG. 1 is a schematic view illustrating the structure of an atomizer for an electronic cigarette according to embodiments of the present disclosure taken from one perspective.

1 atomization compartment housing
11 housing body
111 atomization cavity
112 opening
113 through groove
114 boss
12 cover plate
121 central hole
122 through hole
13 injection plug
14 partition
141 injection orifice
142 bypass hole
15 fastener
2 atomizer assembly
21 storage compartment
211 metal column
22 flow diverting net
23 heating element
231 secure column
3 outer cover
31 first outer cover body
311 suction nozzle opening
32 second outer cover body
321 communication hole
4 leakage-proof sleeve
5 magnetic module

DETAILED DESCRIPTION

The technical solutions of the present disclosure are further described hereinafter in conjunction with drawings. Apparently, the embodiments described below are part, not all, of embodiments of the present disclosure. In the description of the present disclosure, unless otherwise expressly specified and limited, the term "connected to each other", "connected", or "fixed" is to be construed in a broad sense, for example, as securely connected, detachably connected, or integrated; mechanically connected or electrically connected; directly connected to each other or indirectly connected to each other through an intermediary; or internally connected or interactional between two components. For those of ordinary skill in the art, meanings of the preceding terms in the present disclosure may be construed based on situations.

In the present disclosure, unless otherwise expressly specified and limited, when a first feature is described as "above" or "below" a second feature, the first feature and the second feature may be in direct contact or be in contact through another feature between the two features. Moreover, when the first feature is described as "on", "above", or "over" the second feature, the first feature is right "on", "above", or "over" the second feature or the first feature is obliquely "on", "above", or "over" the second feature, or the first feature is simply at a higher level than the second feature. When the first feature is described as "under", "below", or "underneath" the second feature, the first feature right is "under", "below", or "underneath" the second feature or the first feature is obliquely "under", "below", or "underneath" the second feature, or the first feature is simply at a lower level than the second feature.

The present embodiments provide an atomizer for an electronic cigarette. As shown in FIGS. 1 to 4, the atomizer for an electronic cigarette includes an atomization compartment housing 1, an atomizer assembly 2 and an outer cover 3 covering the atomization compartment housing 1. The outer cover 3 is provided with a suction nozzle opening 311 and a communication hole 321 communicating with the suction nozzle opening 311. The atomization compartment housing 1 includes an atomization cavity 111, an opening 112 and a through groove 113. In an embodiment, the atomization cavity 111 is disposed inside the atomization compartment housing 1 and the atomizer assembly 2 is disposed inside the atomization cavity 111. The opening 112 is disposed at an end of the atomization compartment housing 1 and communicates with the atomization cavity 111. The opening 112 and the atomization cavity 111 form a smoke passage that communicates with the suction nozzle opening 311. A side of the opening 112 facing the suction nozzle opening 311 can form a negative pressure such that atomized electronic cigarette liquid can flow through the opening 112. The through groove 113 is disposed in an outer wall of the atomization compartment housing 1. The through groove 113 and the outer cover 3 form an intake passage. Two ends of the intake passage communicate with the suction nozzle opening 311 and the communication hole 321 respectively.

Two ends of the intake passage communicate with the suction nozzle opening 311 and the communication hole 321 respectively. During inhalation, an inspiratory airflow passes through the communication hole 321, the intake passage and the suction nozzle opening 311 successively and then enters the mouth of a user. In the atomization cavity 111, the atomizer assembly 2 atomizes electronic cigarette liquid. When there is no external force, the atomized electronic cigarette liquid remains inside the atomization cavity 111. During inhalation, a side of the opening 112 facing the suction nozzle opening 311 forms a negative pressure such that the atomized electronic cigarette liquid inside the atomization cavity 111 can flow through the opening 112, mix with the inspiratory airflow and then enter the mouth of the user through the suction nozzle opening 311. The atomized electronic cigarette liquid inside the atomization cavity 111 only overflows when the inspiratory airflow forms a negative pressure so that the electronic cigarette liquid leakage is prevented. At the same time, since the smoke passage does not directly communicate with the communication hole 321 and is disposed apart from the atomization cavity 111 through the through groove 113 such that the smoke passage and the intake passage are disposed apart from each other. The inspiratory airflow converges at the suction nozzle opening 311 through the intake passage and directly enters the mouth of the user without passing through the atomization cavity 111 so that the inspiratory airflow is prevented from driving the large-particle smoke inside the atomization cavity 111 to be inhaled into the mouth of the user, and thus the taste can be improved. Moreover, the electronic cigarette liquid can only overflow from one end of the nozzle, so even though the user mistakes one end of the communication hole 321 of the electronic cigarette for intake as the nozzle, the possibility that electronic cigarette liquid is inhaled into the mouth of the user can be reduced, and thus discomfort of the respiratory tract caused by sucking electronic cigarette liquid can be prevented.

Figure 2:
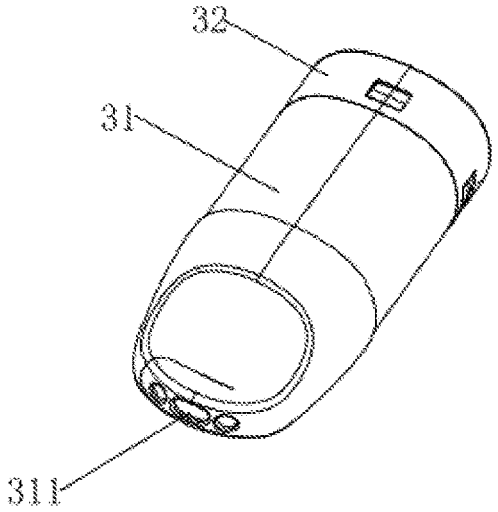
FIG. 2 is a schematic view illustrating the structure of an atomizer for an electronic cigarette according to embodiments of the present disclosure taken from another perspective.
Figure 3:
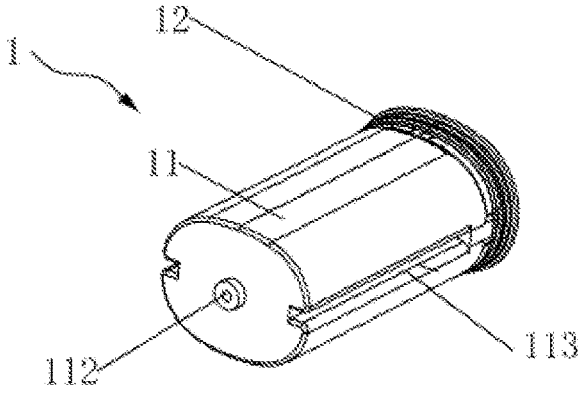
FIG. 3 is a schematic view illustrating the structure of an atomizer for an electronic cigarette whose outer cover is removed according to embodiments of the present disclosure.
Figure 4:
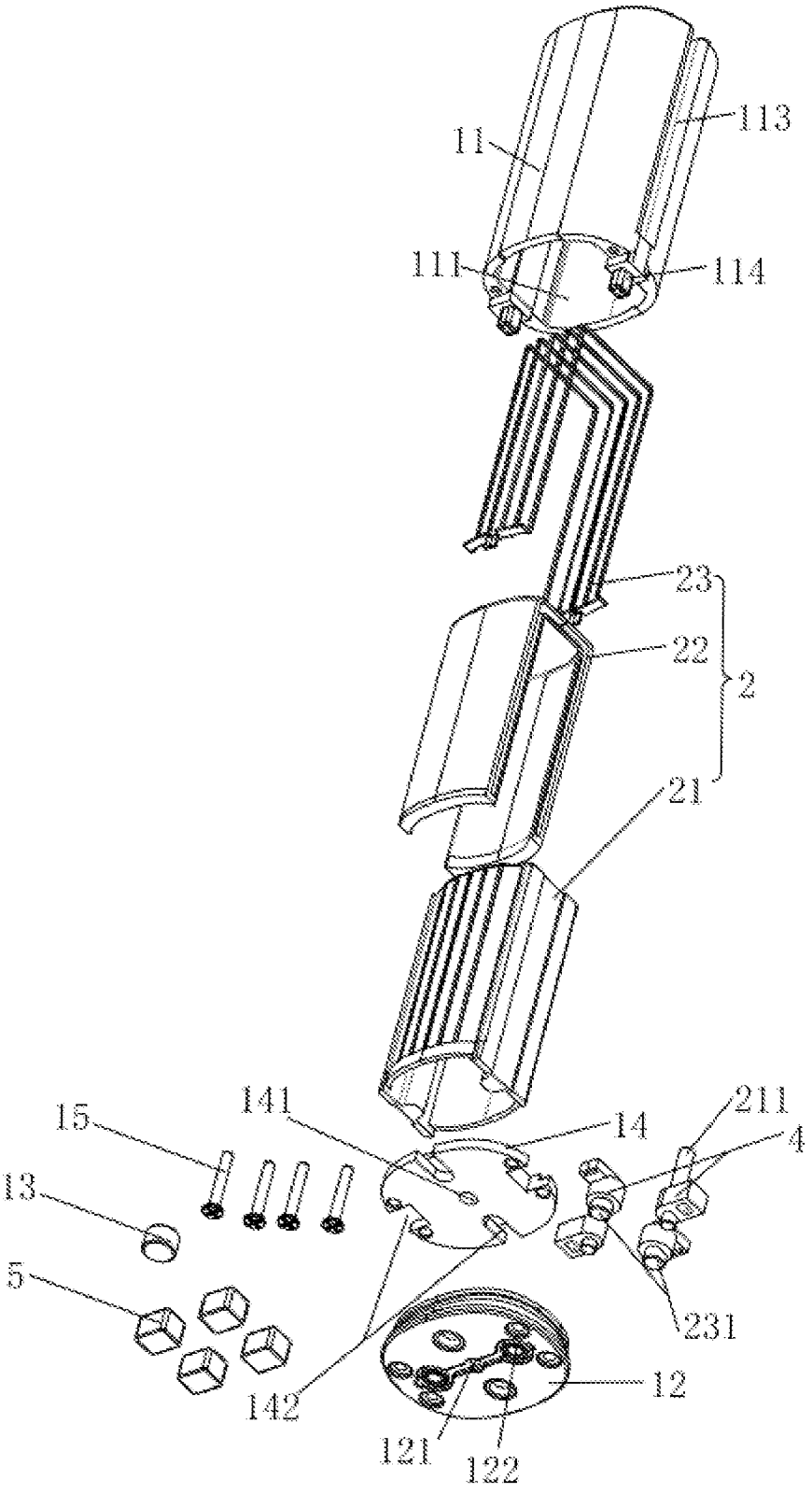
FIG. 4 is an exploded view of an atomizer for an electronic cigarette whose outer cover is removed according to embodiments of the present disclosure.

In the present embodiments, as shown in FIGS. 2 to 3, the suction nozzle opening 311 of the atomization compartment housing 1 is disposed to be directly opposite to the opening 112, facilitating the atomized electronic cigarette liquid that overflows to enter the mouth of the user through the suction nozzle opening 311. When the suction nozzle opening 311 is enlarged, the flow of the inspiratory airflow and the overflowing flow of the atomized electronic cigarette liquid are increased. In an embodiment, the size of the suction nozzle opening 311 can be properly increased or decreased according to the taste. Alternatively, a plurality of suction nozzle openings 311 may be provided.

Optionally, the atomization compartment housing 1 includes a housing body 11 and a cover plate 12. The atomization cavity 111 and the opening 112 are disposed on the housing body 11 that is provided with at least one through groove 113 along a circumferential direction. The cover plate 12 is sealedly disposed at an end of the atomization cavity 111 facing away from the opening 112 and is provided with a central hole 121 and at least one through hole 122 communicating with the central hole 121. The at least through hole 121 is in one-to-one correspondence with and communicates with the at least through groove 113. The central hole 121 communicates with the communication hole 321 and can communicate with the outside air through the communication hole 321. During inhalation, the outside air divisionally flows to each of the through holes 122 through the central hole 121, and enters the mouth of the user through the intake passage. The outside air divisionally flows to a plurality of intake passages through a same central hole 121 such that the inspiratory airflow inside each of the plurality of intake passages is even. The plurality of intake passages are disposed at the periphery of the smoke passage to form an even external pressure at the periphery of the opening 112 so as to facilitate the atomized electronic cigarette liquid to overflow. In an embodiment, the central hole 121 communicates with the through hole 122 through the through groove 113 and the structure is simple. In the present embodiments, two through grooves 113 are symmetrically disposed on two sides of the housing body 11 to enable the inspiratory airflow to more evenly pass through the suction nozzle opening 311 and the structure is simple. Further, in the present embodiments, three suction nozzle openings 311 are disposed. The middle suction nozzle opening 311 is disposed to be directly opposite to the opening 112. Two of the sided suction nozzle openings 311 are symmetrically disposed on two sides of the middle suction nozzle opening 311 and are disposed to be opposite to the two of the through grooves 113.

In an embodiment, the periphery of the cover plate 12 is provided with a sealing groove that is provided with a sealing ring so as to enable a sealing connection between the cover plate 12 and the outer cover 3 so that the sealing properties can be improved. In the present embodiments, two sealing rings are disposed to improve the sealing effect.

Optionally, the atomization compartment housing 1 is provided with an injection orifice 141 communicating with the atomization cavity 111 and further includes an injection plug 13 configured to occlude the injection orifice 141. An external injector is able to pierce through the injection plug 13 to inject electronic cigarette liquid into the atomization cavity 111 and the injection plug 13 facilitates the external injector to inject the electronic cigarette liquid into the atomization cavity 111. A user can freely choose to add different kinds of electronic cigarette liquids according to their own preferences and can fully experience the impact of different flavors of electronic cigarette liquids on their taste buds according to their own preferences of the flavors, which fully demonstrates their personalities. The injection plug 13 can seal up a perforation formed by the external injector piercing through the injection plug 13 so as to avoid the electronic cigarette liquid leakage from the perforation after the injector injects the electronic cigarette liquid. In an embodiment, the material of the injection plug 13 is selected to be food grade super resilient silica gal.

Optionally, the atomization compartment housing 1 further includes a partition 14 disposed between the cover plate 12 and the housing body 11 and sealedly connected to the housing body 111. The partition 14 is disposed to improve the sealing of the atomization cavity 111 so as to further prevent the electronic cigarette liquid leakage so that the sealing effect of the atomization cavity 111 can be improved. The injection orifice 141 is disposed on the partition 14. The external injector pierces through the central hole 121 and the injection orifice 141 successively so as to facilitate the external injector to inject the electronic cigarette liquid into the atomization cavity 111. In an embodiment, a space is formed between the cover plate 12 and the partition 14. The injection plug 13 is disposed between the cover plate 12 and partition 14. Two ends of the injection plug 13 abut against the cover plate 12 and partition 14 respectively so that the mounting stability of the injection plug 13 is improved. Moreover, the injection plug 13 is configured to occlude the central hole 121 and the injection orifice 141 so as to improve the sealing effect. In an embodiment, the cover plate 12, the partition 14 and the housing body 11 are detachably connected to each other to facilitate disassembly. In the present embodiments, a fastener 15 pierces through the cover plate 12, the partition 14 and the housing body 11 successively to make them securely connected.

Optionally, the atomization compartment housing 1 further includes a magnetic module 5 disposed in the space formed between the partition 14 and the cover plate 12. The magnetic module 5 is configured to attract an external power supply module so as to improve the mounting stability of the external power supply module. In the present embodiments, the magnetic module 5 includes four magnetic blocks. In an embodiment, two ends of the magnetic block abut against the cover plate 12 and the partition 14 respectively to improve the mounting stability of the magnetic block.

Optionally, the atomizer assembly 2 includes a storage compartment 21, a flow diverting net 22 and a heating element 23. The storage compartment 21 can generate heat and electronic cigarette liquid is disposed inside the storage compartment 21. The flow diverting net 22 is disposed to enclose an inner compartment and an outer wall of the storage compartment 21, and the heating element 23 is disposed to enclose the flow diverting net 22. In an embodiment, the storage compartment 21 can generate heat to atomize the electronic cigarette liquid inside the storage compartment 21 to prevent the electronic cigarette liquid from solidifying so as to improve the atomization effect. The flow diverting net 22 disposed in the inner compartment seeps the electronic cigarette liquid into the flow diverting net 22 disposed on the outer wall and the heating element 23 generates heat to atomize the electronic cigarette liquid seeped on the flow diverting net 22 disposed on the outer wall once again. Therefore, the electronic cigarette liquid can be fully atomized to improve the experience sense of the user through the method that the electronic cigarette liquid absorbed on the flow diverting net are heated to be atomized twice.

Optionally, the storage compartment 21 includes a compartment body configured to store electronic cigarette liquid, a heating metal layer disposed on the compartment body and a metal column 211 disposed on the compartment body. The compartment body is secured to the atomization compartment housing 1 through the metal column 211 that is disposed to pierce through the atomization compartment housing 1. The heating metal layer is electrically connected to an external power supply module through the metal column 211 and generates heat through conduction. In an embodiment, one end of the storage compartment 21 is open to facilitate to accommodate the electronic cigarette liquid. The partition 14 is occluded on the open to prevent the electronic cigarette liquid leakage so that the storage compartment 21 can not only store the electronic cigarette liquid, but also can atomize the electronic cigarette liquid.

Optionally, the heating element 23 includes a metal net and a secure column 231 connected to the metal net. The metal net is disposed to enclose the flow diverting net 22 and is secured to the atomization compartment housing 1 through the secure column 231 that is disposed to pierce through the atomization compartment housing 1. The metal net is electrically connected to an external power supply module through the secure column 231. The heating element 23 generates heat through conduction. In the present embodiments, the heating element 23 includes the metal net. The secure column 231 is securely connected to the metal net that is secured to the atomization compartment housing 1 through the secure column 231. The storage compartment 21 and the heating element 23 belongs to two different groups of conductive heating lines and atomize the electronic cigarette liquid on the flow diverting net 22 respectively and the structure is simple and compact. In an embodiment, the cover plate 12 is provided with a mounting hole. The metal column 211 and the secure column 231 each form interference fit with the mounting hole to improve the mounting stability.

Further, optionally, leakage-proof sleeves 4 are also included. One of the leakage-proof sleeves 4 is sleeved on the metal column 211 and another one of the leakage-proof sleeves 4 is sleeved on the secure column 231. The one of the leakage-proof sleeves 4 sealedly connects the metal column 211 to the atomization compartment housing 1, and the another one of the leakage-proof sleeves 4 sealedly connects the secure column 231 to the atomization compartment housing 1 so that the electronic cigarette liquid leakage is prevented. In an embodiment, the leakage-proof sleeve 4 is disposed in the space formed between the partition 14 and the cover plate 12 and two ends of the leakage-proof sleeve 4 abut against the partition 14 and the cover plate 12 respectively so as to improve the mounting stability of the leakage-proof sleeve 4. Moreover, the leakage-proof sleeve 4 can occlude a mounting gap between the cover plate 12 and the secure column 231, a mounting gap between the partition 14 and the secure column 231, a mounting gap between the cover plate 12 and the metal column 211 and a mounting gap between the partition 14 and the metal column 211.

In the present embodiments, the secure column 231 further includes a first connecting portion and a second connecting portion that are connected to each other and are both L-shaped. The first connecting portion is connected to the metal net, and the leakage-proof sleeve 4 is disposed on the second connecting portion. In an embodiment, the first connecting portion may be inserted into or may be buckled with the metal net. The second connecting portion may be cylindrical or in other shapes. The leakage-proof sleeve 4 is sleeved on the second connecting portion in a sleeve shape.

In the present embodiments, the metal column 211 is cylindrical. One end of the metal column 211 may be inserted into the compartment body, or when the compartment body is a plastic part, the metal column 211 may further be integrated with the compartment body, alternatively one end of the metal column 211 is connected to the compartment body through a thread and the leakage-proof sleeve 4 is sleeved on the other end of the metal column 211. In an embodiment, the housing body 11 is provided with a boss 114. The through groove 113 is disposed to extend to the boss 114 and the leakage-proof sleeve 4 is sleeved on the boss 114 so as to improve the mounting stability of the leakage-proof sleeve 4 and the metal column 211.

In an embodiment, the partition 14 is provided with a bypass hole 142 configured to bypass the secure column 231 and the metal column 211. In an embodiment, one side of the cover plate 12 facing the partition 14 is provided with a plurality of mounting grooves. The plurality of mounting grooves match the shape of the magnetic bock, the shape of the injection plug 13 and the shape of the leakage-proof sleeve 4 respectively to prevent a structural displacement so as to further improve the mounting stability and the mounting stability of the secure column 231 and the metal column 211 at the same time.

Optionally, the outer cover 3 includes a first outer cover body 31 and a second outer cover body 32 that are connected to each other. The suction nozzle opening 311 is disposed in the first outer cover body 31 and the communication hole 321 is disposed in the second outer cover body 32. The atomization compartment housing 1 is disposed in an accommodation space formed by the first outer cover body 31 and the second outer cover body 32 to facilitate to mount the atomization housing body inside the outer cover 3. In an embodiment, the second outer cover body 32 covers the atomization compartment housing 1 from one end of the disposed cover plate 12 and the first outer cover body 31 covers the atomization compartment housing 1 from one end of the disposed housing body 11. In an embodiment, the first outer cover body 31 and the second outer cover body 32 may be detachably connected to facilitate disassembly and assembly. In the present embodiments, the first outer cover body 31 is buckled with the second outer cover body 32. In an embodiment, the second outer cover body 32 is provided with mounting holes around the communication hole 321. The metal column 211 and the secure column 231 pierce through the mounting hole and are electrically connected to an outer power supply module.

The present disclosure further provides an electronic cigarette. The electronic cigarette includes the atomizer for an electronic cigarette. A smoke passage and an intake passage are disposed apart from each other. An inspiratory airflow converges at the suction nozzle opening 311 through the intake passage and directly enters the mouth of a user without passing through the atomization cavity 111 so that the inspiratory airflow is prevented from driving the large-particle smoke inside the atomization cavity 111 to be inhaled into the mouth of the user, and thus the taste can be improved. Moreover, even though the user mistakes one end of the communication hole of the electronic cigarette for intake as the nozzle, the possibility that electronic cigarette liquid is inhaled into the mouth of the user can be reduced, and thus discomfort of the respiratory tract caused by sucking electronic cigarette liquid can be prevented.

The present disclosure provides an atomizer for an electronic cigarette. Two ends of an intake passage communicate with a suction nozzle opening and a communication hole respectively. During inhalation, an inspiratory airflow passes through the communication hole, the intake passage and the suction nozzle opening successively and then enters the mouth of a user. In an atomization cavity, an atomizer assembly atomizes electronic cigarette liquid. When there is no external force, the atomized electronic cigarette liquid remains inside the atomization cavity. During inhalation, a side of an opening facing the suction nozzle opening forms a negative pressure such that the atomized electronic cigarette liquid inside the atomization cavity can flow through the opening, mix with the inspiratory airflow and then enter the mouth of the user through the suction nozzle opening. The atomized electronic cigarette liquid inside the atomization cavity can only overflow when the inspiratory airflow forms a negative pressure so that electronic cigarette liquid leakage is prevented. At the same time, since a smoke passage does not directly communicate with the communication hole and is disposed apart from the atomization cavity through the through groove such that the smoke passage and the intake passage are disposed apart from each other. The inspiratory airflow converges at the suction nozzle opening through the intake passage and directly enters the mouth of the user without passing through the atomization cavity so that the inspiratory airflow is prevented from driving the large-particle smoke to be inhaled into the mouth of the user, and thus the taste can be improved. Moreover, even though the user mistakes one end of the communication hole of the electronic cigarette for intake as the nozzle, the possibility that electronic cigarette liquid is inhaled into the mouth of the user can be reduced, and thus discomfort of the respiratory tract caused by sucking electronic cigarette liquid can be prevented.

Moreover, in the electronic cigarette provided in the present disclosure, the atomizer for an electronic cigarette is used such that the smoke passage and the intake passage are disposed apart from each other. The inspiratory airflow converges at the suction nozzle opening through the intake passage and directly enters the mouth of the user without passing through the atomization cavity so that the inspiratory airflow is prevented from driving the large-particle smoke inside the atomization cavity to be inhaled into the mouth of the user, and thus the taste can be improved. Moreover, even though the user mistakes one end of the communication hole of the electronic cigarette for intake as the nozzle, the possibility that electronic cigarette liquid is inhaled into the mouth of the user can be reduced, and thus discomfort of the respiratory tract caused by sucking electronic cigarette liquid can be prevented.

What is claimed is:

1. An atomizer for an electronic cigarette, comprising:

an atomization compartment housing, an atomizer assembly, and an outer cover covering the atomization compartment housing, wherein the outer cover is provided with a suction nozzle opening and a communication hole communicating with the suction nozzle opening, the atomization compartment housing further includes:

an atomization cavity disposed inside the atomization compartment housing, wherein the atomizer assembly is disposed inside the atomization cavity;

an opening disposed at an end of the atomization compartment housing and communicating with the atomization cavity, wherein the opening and the atomization cavity form a smoke passage, wherein the smoke passage communicates with the suction nozzle opening, and the opening is configured to allow atomized electronic cigarette liquid to flow through under a negative pressure formed on a side of the opening facing the suction nozzle opening; and a through groove disposed in an outer wall of the atomization compartment housing, wherein the through groove and the outer cover form an intake passage, wherein two ends of the intake passage communicate with the suction nozzle opening and the communication hole respectively;

the atomizer assembly further includes:

a storage compartment capable of generating heat, wherein electronic cigarette liquid is disposed inside the storage compartment;

a flow diverting net disposed to enclose an inner compartment and an outer wall of the storage compartment; and a heating element disposed to enclose the flow diverting net;

wherein the storage compartment includes a compartment body, a heating metal layer disposed on the compartment body and a metal column disposed on the compartment body, wherein the electronic cigarette liquid is disposed inside the compartment body, the compartment body is secured to the atomization compartment housing through the metal column, the metal column is disposed to pierce through the atomization compartment housing, and the heating metal layer is configured to be electrically connected to the external power supply module through the metal column; and wherein the heating element includes a metal net and a secure column connected to the metal net, wherein the metal net is disposed to enclose the flow diverting net, the metal net is secured to the atomization compartment housing through the secure column, the secure column is disposed to pierce through the atomization compartment housing, and the metal net is configured to be electrically connected to the external power supply module through the secure column.

2. The atomizer for an electronic cigarette according to claim 1, wherein the atomization compartment housing comprises:

a housing body, wherein the atomization cavity and the opening are disposed on the housing body, and the housing body is provided with a through groove; and a cover plate sealedly disposed at an end of the atomization cavity facing away from the opening, wherein the cover plate is provided with a central hole and a through hole communicating with the central hole, wherein the through hole communicates with the through groove, and the central hole communicates with the communication hole.

3. The atomizer for an electronic cigarette according to claim 1, wherein the atomization compartment housing comprises:

a housing body, wherein the atomization cavity and the opening are disposed on the housing body, and the housing body is provided with through grooves along a circumferential direction; and a cover plate sealedly disposed at an end of the atomization cavity facing away from the opening, wherein the cover plate is provided with a central hole and through holes communicating with the central hole, wherein the through holes are in one-to-one correspondence with and communicate with the through grooves, and the central hole communicates with the communication holes.

4. The atomizer for an electronic cigarette according to claim 2, wherein the atomization compartment housing is provided with an injection orifice communicating with the atomization cavity, the atomization compartment housing further comprises an injection plug configured to occlude the injection orifice, an external injector is able to pierce through the injection plug to inject electronic cigarette liquid into the atomization cavity, and the injection plug is able to seal up a perforation formed by the external injector piercing through the injection plug.

5. The atomizer for an electronic cigarette according to claim 4, wherein the atomization compartment housing further comprises a partition disposed between the cover plate and the housing body and sealedly connected to the housing body, the injection orifice is disposed on the partition, and the external injector is able to pierce through the central hole and the injection orifice successively.

6. The atomizer for an electronic cigarette according to claim 5, wherein the atomization compartment housing further comprises a magnetic module, and a space is formed between the partition and the cover plate, wherein the magnetic module is disposed in the space and is configured to attract an external power supply module.

7. The atomizer for an electronic cigarette according to claim 1, further comprising leakage-proof sleeves, wherein one of the leakage-proof sleeves is sleeved on the metal column and another one of the leakage-proof sleeves is sleeved on the secure column, the one of the leakage-proof sleeves sealedly connects the metal column to the atomization compartment housing, and the another one of the leakage-proof sleeves sealedly connects the secure column to the atomization compartment housing.

8. The atomizer for an electronic cigarette according to claim 1, wherein the outer cover comprises a first outer cover body and a second outer cover body that are connected to each other, the suction nozzle opening is disposed in the first outer cover body, the communication hole is disposed in the second outer cover body, and the atomization compartment housing is disposed in an accommodation space formed by the first outer cover body and the second outer cover body.

9. An electronic cigarette, comprising:

an atomizer for an electronic cigarette, wherein the atomizer for an electronic cigarette includes an atomization compartment housing, an atomizer assembly, and an outer cover covering the atomization compartment housing, wherein the outer cover is provided with a suction nozzle opening and a communication hole communicating with the suction nozzle opening, the atomization compartment housing further includes:

an atomization cavity disposed inside the atomization compartment housing, wherein the atomizer assembly is disposed inside the atomization cavity;

an opening disposed at an end of the atomization compartment housing and communicating with the atomization cavity, wherein the opening and the atomization cavity form a smoke passage, wherein the smoke passage communicates with the suction nozzle opening, and the opening is configured to allow atomized electronic cigarette liquid to flow through under a negative pressure formed on a side of the opening facing the suction nozzle opening; and a through groove disposed in an outer wall of the atomization compartment housing, wherein the through groove and the outer cover form an intake passage, wherein two ends of the intake passage communicate with the suction nozzle opening and the communication hole respectively;

the atomizer assembly further includes:

a storage compartment capable of generating heat, wherein electronic cigarette liquid is disposed inside the storage compartment;

a flow diverting net disposed to enclose an inner compartment and an outer wall of the storage compartment; and a heating element disposed to enclose the flow diverting net; and wherein the storage compartment includes a compartment body, a heating metal layer disposed on the compartment body and a metal column disposed on the compartment body, wherein the electronic cigarette liquid is disposed inside the compartment body, the compartment body is secured to the atomization compartment housing through the metal column, the metal column is disposed to pierce through the atomization compartment housing, and the heating metal layer is configured to be electrically connected to the external power supply module through the metal column; and wherein the heating element comprises a metal net and a secure column connected to the metal net, wherein the metal net is disposed to enclose the flow diverting net, the metal net is secured to the atomization compartment housing through the secure column, the secure column is disposed to pierce through the atomization compartment housing, and the metal net is configured to be electrically connected to the external power supply module through the secure column.

10. The electronic cigarette according to claim 9, wherein the atomization compartment housing comprises:

a housing body, wherein the atomization cavity and the opening are disposed on the housing body, and the housing body is provided with a through groove; and a cover plate sealedly disposed at an end of the atomization cavity facing away from the opening, wherein the cover plate is provided with a central hole and a through hole communicating with the central hole, wherein the through hole communicates with the through groove, and the central hole communicates with the communication hole.

11. The electronic cigarette according to claim 9, wherein the atomization compartment housing comprises:

a housing body, wherein the atomization cavity and the opening are disposed on the housing body, and the housing body is provided with through grooves along a circumferential direction; and a cover plate sealedly disposed at an end of the atomization cavity facing away from the opening, wherein the cover plate is provided with a central hole and through holes communicating with the central hole, wherein the through holes are in one-to-one correspondence with and communicate with the through grooves, and the central hole communicates with the communication holes.

12. The electronic cigarette according to claim 10, wherein the atomization compartment housing is provided with an injection orifice communicating with the atomization cavity, the atomization compartment housing further comprises an injection plug configured to occlude the injection orifice, an external injector is able to pierce through the injection plug to inject electronic cigarette liquid into the atomization cavity, and the injection plug is able to seal up a perforation formed by the external injector piercing through the injection plug.

13. The electronic cigarette according to claim 12, wherein the atomization compartment housing further comprises a partition disposed between the cover plate and the housing body and sealedly connected to the housing body, the injection orifice is disposed on the partition, and the external injector is able to pierce through the central hole and the injection orifice successively.

14. The electronic cigarette according to claim 13, wherein the atomization compartment housing further comprises a magnetic module and a space is formed between the partition and the cover plate, wherein the magnetic module is disposed in the space and is configured to attract an external power supply module.

15. The electronic cigarette according to claim 9, further comprising leakage-proof sleeves, wherein one of the leakage-proof sleeves is sleeved on the metal column and another one of the leakage-proof sleeves is sleeved on the secure column, the one of the leakage-proof sleeves sealedly connects the metal column to the atomization compartment housing, and the another one of the leakage-proof sleeves sealedly connects the secure column to the atomization compartment housing.

16. The electronic cigarette according to claim 9, wherein the outer cover comprises a first outer cover body and a second outer cover body that are connected to each other, the suction nozzle opening is disposed in the first outer cover body, the communication hole is disposed in the second outer cover body, and the atomization compartment housing is disposed in an accommodation space formed by the first outer cover body and the second outer cover body.

* * * * *